US005123537A

United States Patent [19]

Gresens

[11] Patent Number: 5,123,537

[45] Date of Patent: Jun. 23, 1992

[54] TRAY STACKING SYSTEM

[75] Inventor: Stanley Gresens, Homewood, Ill.

[73] Assignee: Fellowes Manufacturing Company, Itasca, Ill.

[21] Appl. No.: 679,730

[22] Filed: Apr. 3, 1991

[51] Int. Cl.[5] ..... B65D 21/04

[52] U.S. Cl. ..... 206/511; 206/513; 206/821; 206/503; 220/630; 220/636; 211/126

[58] Field of Search ..... 206/503, 506, 511, 513, 206/821; 220/85 R, 485, 630, 631, 636, 647; 211/126

[56] References Cited

U.S. PATENT DOCUMENTS

| | | | |
|---|---|---|---|
| 987,410 | 3/1911 | Snyder | 211/126 |
| 994,984 | 6/1911 | Dennis | 206/821 |
| 1,386,788 | 8/1921 | Lamp | 206/821 |
| 1,396,148 | 11/1921 | Snyder | 206/821 |
| 2,603,361 | 7/1952 | James . | |
| 2,721,663 | 10/1955 | James | 211/126 |
| 2,954,127 | 9/1960 | Smit . | |
| 3,053,397 | 9/1962 | Bliss . | |
| 3,552,579 | 1/1971 | Simon | 206/821 |
| 3,887,073 | 6/1975 | Wilson . | |
| 4,241,831 | 12/1980 | Locatelli | 206/513 |
| 4,452,581 | 6/1984 | Panehal | 220/85 R |
| 4,498,595 | 2/1985 | Wilson | 206/821 |
| 4,534,475 | 8/1985 | Mayo | 211/126 |
| 5,022,546 | 6/1991 | Bock | 206/506 |

FOREIGN PATENT DOCUMENTS

| | | | |
|---|---|---|---|
| 1172184 | 6/1964 | Fed. Rep. of Germany | 206/821 |
| 1192087 | 10/1959 | France | 206/821 |

*Primary Examiner*—Stephen Marcus
*Assistant Examiner*—S. Castellano
*Attorney, Agent, or Firm*—Willian Brinks Olds Hofer Gilson & Lione

[57] ABSTRACT

A tray stacking system utilizes a crescent-shaped connector for attaching a plurality of stacked trays, the connector having a head portion and a tail portion. The head portion has a groove formed therein for attaching to a rung of a top tray. The tail portion has a groove formed therein for attaching to the top rung of a bottom tray. The connector also functions as a base for the bottom tray, and has a side groove formed in the tail portion for attaching to a base rung of a bottom tray.

13 Claims, 2 Drawing Sheets

TRAY STACKING SYSTEM

BACKGROUND OF THE INVENTION

This invention relates to a tray stacking system and a connector used in that system. Tray stacking systems are most often used in an office environment to hold papers, folders and like materials. One tray is connected to another tray to form a stack and the connectors used in the stacking systems are rigid vertically extending structures. For example, posts formed in four corners of a tray, V-shaped legs, or wire legs are all disclosed in the prior art. These connecting systems often require more than one part to affix to the tray, or as with the post system, are more conducive for use with plastic rather than metal trays.

The present invention is directed at a tray stacking system which requires a connector with only one part, that can be easily manufactured. This will lower the cost of the system and also allow for easy assembly. In addition, the connector also functions as a base for the tray.

Accordingly, one object of the invention is to provide a simple, inexpensive design which provides easy assembly and manufacture.

A further objective of the invention is to provide a connector that also functions as a base for the tray.

SUMMARY OF THE INVENTION

This invention provides a tray stacking system comprising one or more trays and a plurality of crescent-shaped connectors which also function as a base for the bottom tray in the stack. The tray is composed of a rigid material (i.e., metal, plastic) having a bottom, two sides, and a back portion. The front of the tray is open. Parallel rungs running horizontally on each of the sides provide a connecting point for a head portion of the crescent-shaped connector. It is only necessary for the rungs to be positioned at connecting points.

The crescent-shaped connector has three grooves cut out of its surface which clip onto the rungs of the trays. The tail portion of the crescent-shaped connector connects to the top rung of a lower tray when used as a connector and to the base rung of the same tray when used as a base.

DETAILED DESCRIPTION OF AN EMBODIMENT

Figure 1:
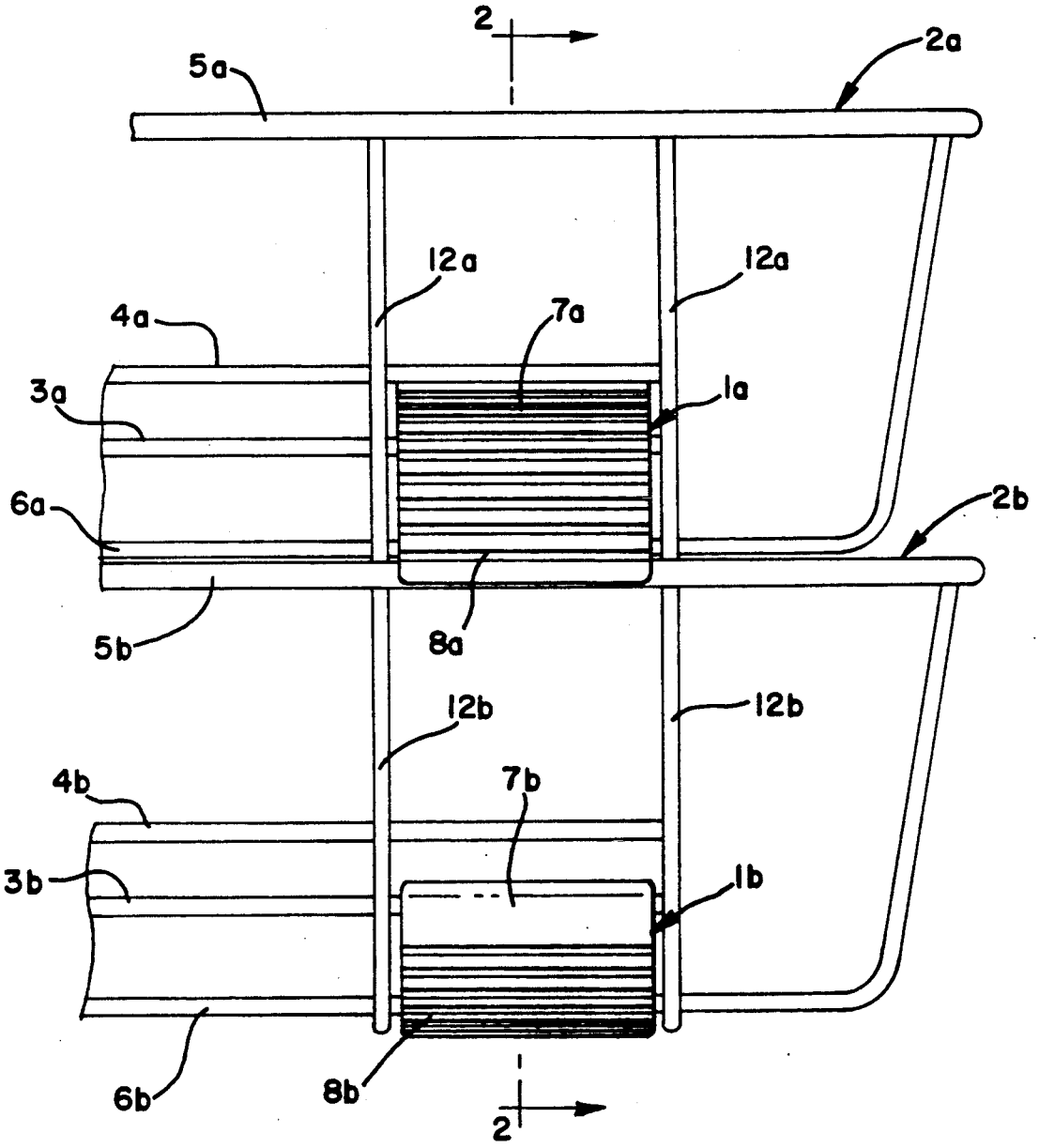
FIG. 1 is a side view of the tray stacking system with crescent-shaped connectors positioned to function as a connector and as a base for the bottom tray.

Referring to FIG. 1, one side of the tray stacking system is shown with two wire trays 2*a* and 2*b* and two connectors 1*a* and 1*b*. The top crescent-shaped connector 1*a* is positioned to perform its connector function. The connector head 7*a* clips onto the head rung 3*a*. Supporting rung 4*a* provides support and stabilizes the connector. Vertical rungs 12*a* help prevent the crescent-shaped connector from moving in the horizontal direction, and again act as stabilizers. Connector end 8*a* is attached to top rung 5*b* of the lower tray 2*b*.

Figure 2:
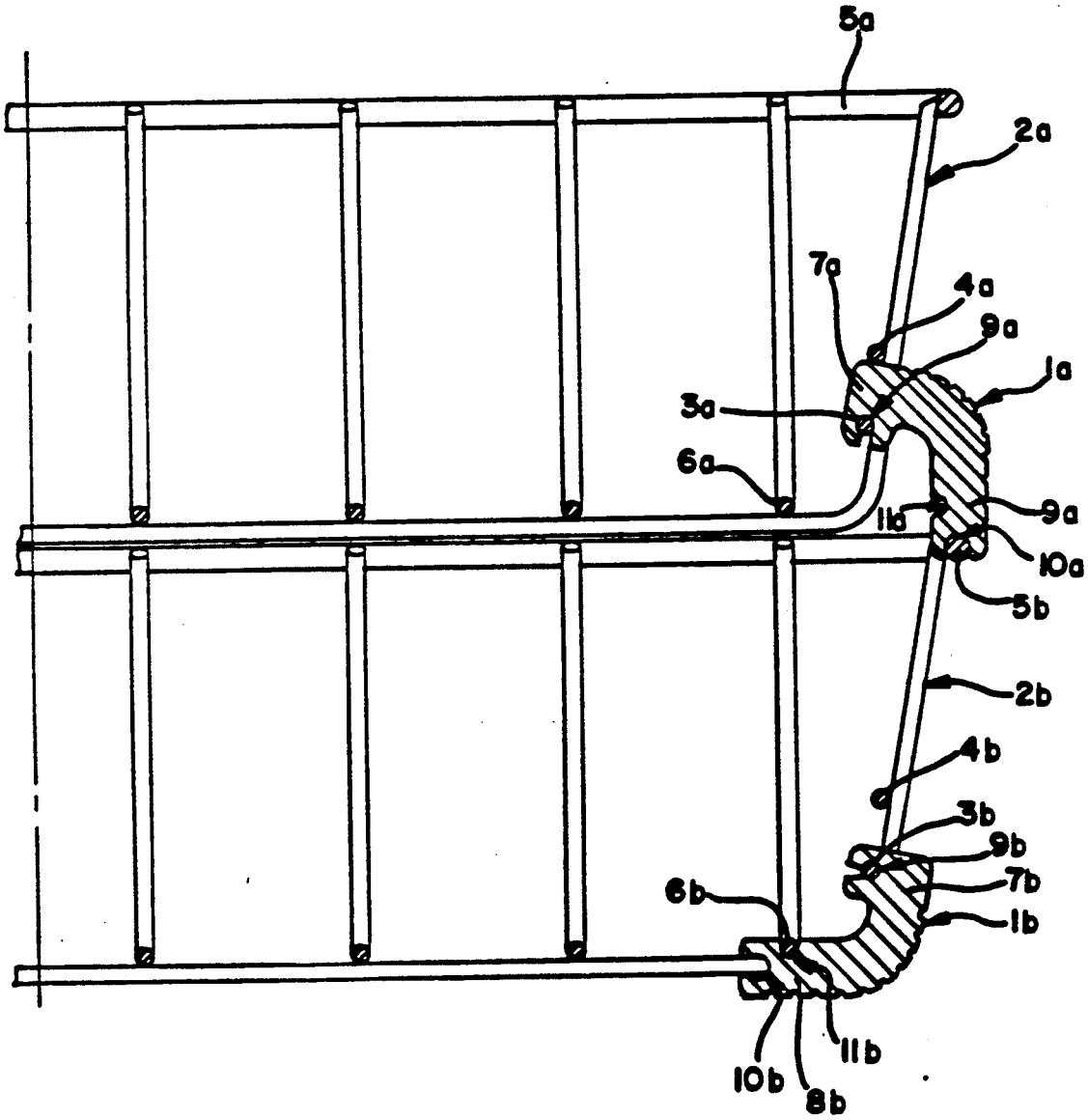
FIG. 2 is a sectional view of the FIG. 1 taken along the axis 2—2.

Referring to FIG. 2, the upper connector 1*a*, performing the connecting function, has formed in the connector head 7*a* a head groove 9*a* which connects to head rung 3*a*. The connector tail 8*a* has formed therein a tail groove 10*a* which connects to the top rung 5*b* of the lower tray 2*b*. When used as a connector, side groove 11*a* does not connect with a tray.

Lower connector 1*b*, performing the base function, also has a connector head 7*b* with head groove 9*b* connected with head rung 3*b*. When used as a base, the lower connector 1*b* is positioned about 90° in relation to the position of the upper connector 1*a*. Rung 4*b* does not contact the connector head when the connector is used as a base. The lower connector tail 8*b* has a side groove 11*b* which attaches to the base rung 6*b*. When used as a base, tail groove 10*b* does not connect with a tray.

Thus, while the invention has been described with reference to a certain embodiment, those skilled in the art will recognize modifications of structure, arrangement, composition and the like that can be made to the present invention, but still fall within the scope of the invention as hereafter claimed.

I claim:

1. A tray stacking system comprising:

at least one pair of bottom and top trays, each tray having a base, a pair of sides, and a back, said base having formed therein a base rung, said pair of sides each having formed therein a top rung, a head rung and a supporting rung;

a plurality of crescent-shaped connectors having a head and a tail, said head having formed therein an elongated head groove for attaching to said head rung of said top tray, said tail having formed therein an elongated tail groove for connecting to said top rung of said bottom tray.

2. The system as defined in claim 1, wherein said trays further comprise at least one pair of vertical rungs, and said plurality of crescent-shaped connectors comprises four connectors attachable between a vertical rung pair.

3. The system as defined in claim 2, wherein said at least one pair of vertical rungs comprises two pairs of vertical rungs equally spaced along said head and said support rungs on each of said sides of said trays.

4. The system as defined in claim 1 wherein said tail of one of said connectors having formed therein a side groove for attaching to said base rung of said bottom tray when said elongated head groove is attached to said head rung of said bottom tray.

5. The system as defined in claim 1 wherein said trays are comprises of metal.

6. The system as defined in claim 1 wherein said trays are comprised of plastic.

7. The system as defined in claim 1 wherein said trays are comprised of metal wire.

8. A multipurpose connector and base for a tray stacking system comprising:

a crescent-shaped structure having a head portion and a tail portion, said head portion having an inward facing arm at the end and an elongated groove formed in the distal end of the arm and substantially perpendicular to the arm, said tail portion having two elongated grooves substantially perpendicular to said tail portion, the first elongated tail groove being formed in the end of the tail portion, and the second elongated tail groove being formed in the inside of the crescent above the end of the tail portion.

9. A stacked tray apparatus comprising:

at least a bottom and a top tray, each tray having a base, a pair of sides, and a back, each of said base having formed therein a base rung, and each of said pair of sides having formed in each side a top rung and a head rung;

a plurality of crescent-shaped connectors, each connector having a head portion and a tail portion, said head portions having formed therein an elongated head groove, each of said head grooves being attached to said head rungs of said top tray, said tail portions having formed therein an elongated tail groove and an elongated side groove, each of said tail grooves being attached to said top rungs of said bottom tray.

10. A stacked tray apparatus comprising:

at least a bottom and a top tray, each tray having a base, a pair of sides, and a back, each of said base having formed therein a base rung, and each of said pair of sides having formed in each side a top rung and a head rung;

a plurality of crescent-shaped connectors, each connector having a head portion and a tail portion, said head portions having formed therein a head groove, each of said head grooves being attached to said head rungs of said top tray, said tail portions having formed therein a tail groove and a side groove, each of said tail grooves being attached to said top rungs of said bottom tray;

a second plurality of crescent-shaped connectors, each of said head grooves in said second plurality of connectors being attached to said head rungs of said bottom tray, and each of said side grooves being attached to said base rungs of said bottom tray.

11. The apparatus as defined in claim 9 wherein a supporting rung is formed in each of said pair of sides, said supporting rung of said top tray contacting said head portion of said connectors.

12. The apparatus as defined in claim 9 further comprising:

a second plurality of identical crescent-shaped connectors, each of said head grooves in said second plurality of connectors being attached to said head rungs of said bottom tray, and each of said side grooves being attached to said base rungs of said bottom tray.

13. The apparatus as defined in claim 10 wherein said second plurality of crescent-shaped connectors is identical to said plurality of crescent-shaped connectors.

* * * * *

UNITED STATES PATENT AND TRADEMARK OFFICE

CERTIFICATE OF CORRECTION

PATENT NO. : 5,123,537

DATED : June 23, 1992

INVENTOR(S) : Stanley Gresens

It is certified that error appears in the above-indentified patent and that said Letters Patent is hereby corrected as shown below:

ON THE TITLE PAGE

UNDER THE HEADING "U.S. PATENT DOCUMENTS"

In the third line, please delete "1,386,788" and substitute therefor --1,386,878--.

In the fifth line, after "James" please insert --.....211/126--.

In the seventh line, after "Smit" please insert --.....211/183--.

In the eighth line, after "Bliss" please insert --.....211/126--.

In the tenth line, after "Wilson" please insert --.....206/507--.

Signed and Sealed this

Sixteenth Day of August, 1994

Bruce Lehman

*Attest:*

BRUCE LEHMAN

*Attesting Officer*

*Commissioner of Patents and Trademarks*